US005913956A

United States Patent [19]

Capps

[11] Patent Number: 5,913,956

[45] Date of Patent: Jun. 22, 1999

[54] APPARATUS AND METHOD FOR PROGRESSIVE FRACTURE OF WORK PIECES IN MECHANICAL PRESSES

[76] Inventor: David F. Capps, 134 Moross, Mt. Clemens, Mich. 48043

[21] Appl. No.: 08/474,328

[22] Filed: Jun. 7, 1995

[51] Int. Cl.[6] ..... B30B 15/22

[52] U.S. Cl. ..... 83/39; 100/35; 100/48; 83/627; 83/13

[58] Field of Search ..... 72/17.3, 20.1, 72/20.4; 83/39, 74, 75, 75.5, 76.7, 627, 13; 100/48, 35

[56] References Cited

U.S. PATENT DOCUMENTS

| | | | |
|---|---|---|---|
| 3,487,736 | 1/1970 | Kaiser et al. | 83/13 |
| 3,566,513 | 3/1971 | Fuller | 83/39 X |
| 3,623,389 | 11/1971 | Krynytzky et al. | 83/617 |
| 3,657,953 | 4/1972 | Sutyak | 83/8 |
| 3,733,943 | 5/1973 | Sutyak | 83/7 |
| 3,827,328 | 8/1974 | Laklamme et al. | 83/617 |
| 3,888,168 | 6/1975 | Kent et al. | 100/48 |
| 3,913,438 | 10/1975 | Walters et al. | 83/627 X |
| 4,088,899 | 5/1978 | Miller et al. | 83/13 X |
| 4,116,122 | 9/1978 | Linder et al. | 100/48 |
| 4,208,935 | 6/1980 | Kollmar | 83/617 |
| 4,214,496 | 7/1980 | Carrier | 83/617 |
| 4,339,975 | 7/1982 | Carrier | 83/617 |
| 4,375,781 | 3/1983 | Bessho | 92/52 |
| 4,462,291 | 7/1984 | Schulz | 83/627 X |
| 4,524,582 | 6/1985 | Lucas et al. | 100/48 X |
| 4,535,689 | 8/1985 | Putkowski | 83/627 X |
| 4,694,744 | 9/1987 | Hepburn et al. | 100/214 |
| 4,771,663 | 9/1988 | Naito et al. | 83/49 |
| 4,784,058 | 11/1988 | Nakayawa et al. | 100/35 |
| 4,918,364 | 4/1990 | Naito | 318/646 |
| 4,945,796 | 8/1990 | Riley | 83/49 |
| 5,027,631 | 7/1991 | Naito | 72/19 |
| 5,031,431 | 7/1991 | Naito | 72/7 |
| 5,042,336 | 8/1991 | Capps | 83/13 |
| 5,176,054 | 1/1993 | Capps | 83/13 |

FOREIGN PATENT DOCUMENTS

| | | |
|---|---|---|
| 3230930 | 2/1984 | Germany . |
| 2186394 | 8/1987 | United Kingdom . |

*Primary Examiner*—Douglas D. Watts
*Assistant Examiner*—Elizabeth Stanley
*Attorney, Agent, or Firm*—Young & Basile

[57] ABSTRACT

A control apparatus and method for progressively fracturing a work piece from a material sheet in a mechanical press in which the separation distance between an upper die and a lower die is varied in discrete steps as an upper platen advances the upper die toward the lower die, each discrete step occurring within the thickness of the material being stamped. Varying the separation distance includes a motion opposite to the relative direction movement of the upper platen at one or more predetermined distances to create a controlled release of stored forces in the dies and press frame. A distance measuring transducer generates an output indicative of the position of the upper die in relation to the lower die. A controller, in response to a stored control program and the output of the distance measuring transducer, controls the operation of fluid valves to supply pressurized fluid to one or more cylinders coupled between one platen and one die to create the relative separation motion between the upper die and the lower die. The controller also controls a pressure regulating valve to supply fluid at a plurality of discrete pressures to the cylinder or cylinders throughout the operation of the press. The controller alternately controls slidable wedges disposed between a plate fixed to one platen and a movable plate fixed to one die to perform the relative separation motion.

17 Claims, 8 Drawing Sheets

APPARATUS AND METHOD FOR PROGRESSIVE FRACTURE OF WORK PIECES IN MECHANICAL PRESSES

BACKGROUND OF THE INVENTION

1. Field of the Invention

The present invention relates, in general, to presses and, specifically, to mechanical presses used in stamping or shearing operations and, more specifically, to control systems for mechanical presses.

2. Description of the Art

Mechanical presses are commonly used to stamp metal parts from flat sheet metal. The press is frequently driven by a large electric motor which turns a large flywheel. This flywheel imparts rotational force to a crank shaft through a clutch which is engaged when operation of the press is desired. The crank shaft drives connecting rods that are connected to a slide section referred to as the upper platen. An upper die that stamps the part being made is attached to the under side of the upper platen and traditionally holds the punches and forms used to form the part being made. A lower die is attached to a generally fixed platform of the press referred to as the lower platen.

In some mechanical presses, the lower platen is not fixed but is made to be movable by means of typically four hydraulic cylinders. These four cylinders perform two general functions. The first function is to act as a dampening system to reduce noise and shock during metal stamping operations. This is done by applying a pressure to the lower platen, through the hydraulic cylinders, that is less than the pressure from the upper platen, thus allowing the motion of the lower platen to slow the progression of the upper platen. This has the overall effect of slowing the breakthrough of the metal and reducing the rate of noise and shock generation. The second function is to provide means for keeping the lower platen parallel to the upper platen during uneven loading of the press platens and frame. In other mechanical presses, the typically four hydraulic cylinders are mounted to the press frame and operate only upon the upper platen, which is fitted with adjustable rods so as to contact the cylinder rods just prior to contact with the material being stamped. Again, the function is to dampen noise and shock generation by slowing the press during metal breakthrough.

As the punch or upper die engages and moves through the metal sheet, forces on the order of several tons are introduced into the dies and the surrounding frame of the press. Such forces progressively increase to a maximum force load at the point of breakthrough of the upper die through the metal sheet. The forces are restrained during the shearing or stamping operation and are stored as distortion or deflection in the dies and in the frame of the press.

These forces are suddenly released when the upper die breaks through the metal sheet resulting in objectionable shock, noise, and vibration. These forces increase correspondingly with the force employed in the stamping or shearing operation. The shock, noise, and vibrations adversely effect the press, surrounding equipment and persons located in the vicinity of the press. Further, these problems occur with each cycle of the press and increase with the force and size of the press.

Because of the noise and shock generated by presses in stamping and shearing operations, presses have been located in an area separated from other manufacturing operations, such as in a separate building or a portion of a large building isolated from other manufacturing operations. This requires shipping, storage, and additional handling of the stamped parts which increases their cost and results in the possibility of damage to the parts.

In order to alleviate or minimize the objectionable characteristics of stamping presses, attempts have been made to decrease the shock, noise, and vibration generated by a press. Such attempts incorporate shock dampening systems into the press which cushion the release of stored forces via a hydraulic; while other systems control the speed of the press during its advance so as to decelerate the press when breakthrough of the work piece occurs. However, such attempts have met with limited success in reducing the shock, noise, and vibration levels generated during a stamping or shearing operation.

Thus, it would be desirable to provide a control apparatus and method for a stamping or shearing press which significantly reduces the shock, noise, and vibration associated with the operation of stamping or shearing presses. It would also be desirable to provide a control apparatus and method for reducing shock, noise, and vibration levels in a stamping press which can be easily adapted to conventional press construction.

SUMMARY OF THE INVENTION

The present invention is a control apparatus and method for the progressive fracture of a work piece from a material sheet in a mechanical press.

The control apparatus includes a die travel distance measuring means, such as a linear transducer, connected to the press and providing an output indicative of the position of the upper die in relation to the lower die. A control means executes a stored control program and, in response to the output of the distance measuring means, controls the separation distance between the upper and lower dies in a series of discrete steps as the upper die advances through the material sheet. These discrete steps are used to control the release of stored forces in the dies and in the press frame. The controlled release of forces is accomplished by stopping the advance of the upper die through the material being stamped at a predetermined position, and then reversing the direction of motion of the upper die by a distance that will allow the stored forces to be released under controlled conditions. The forward motion is resumed to a second predetermined position where the stopping of the advance and reversal of direction is again repeated. The forward motion is again resumed and the stamping operation is completed. The stopping of the advance and reversal of direction may be repeated as needed for specific applications.

In a preferred embodiment, the relative motion of the upper die is controlled by a three-layered plate assembly formed of upper and lower plates respectively mounted between the upper platen and the upper die. This three-layered plate is constructed so that the middle layer includes reciprocating captive wedge-shaped members driven by a fluid-operated cylinder that contact slopped surfaces on the upper and lower plates. As the middle wedge shaped members reciprocate, a change in dimension from top to bottom of the three layered plate assembly is created. This change in top to bottom dimension is used to create the stop in advancement of the upper die and also a reversal in the relative motion of the upper die to the lower die.

In a second embodiment, the relative motion of the upper die to the lower die is created by using one or more cylinders either mounted between the upper die and the upper platen, or between the lower die and the lower platen, or by using cylinders provided as dampening cylinders that are mounted to the lower platen of the press. In each case, the relative motion is created by the motion of the piston rod of a cylinder, or cylinders, moving to a stop and then reversing the motion of the upper die in relation to the lower die or separating the lower die from the upper die.

In one embodiment, the control means, which comprises a controller in the form of a microprocessor based computer executing a control program stored in memory, generates control signals connected to a source of pressurized fluid which supply the pressurized fluid to cylinders mounted between valve means to advance and retract one or more cylinder piston rods and thereby create the stopped and reverse motion of the upper die in association with the output of the distance measuring means.

The valve means preferably provide selective acceleration and deceleration of the cylinder piston rod(s) by controlling the rate of fluid flow to the cylinder, or cylinders, in progressive steps in response to control signals from the control means. Preferably the valve means comprises one or more servo or proportional valves, and provides discrete movement of the cylinder or cylinders piston rods, in minute steps through the material sheet.

The control apparatus of the present invention also includes pump means for pressurizing the fluid from the fluid source. Preferably, the pump means is connected to a pressure regulating means, controlled by the control means, to provide a plurality of discrete pressure levels to the fluid supplied to the cylinder, or cylinders, to selectively control the pressure exerted by the cylinder, or cylinders, during each cycle.

The method of the present invention comprises the steps of:

(a) advancing the upper platen and the upper die from an open position spaced from the lower die toward the lower die;

(b) measuring the distance travelled by the upper die in relation to the lower die;

(c) at a first predetermined distance of advance of the upper die through the material sheet and while the upper platen continues to advance toward the lower die, momentarily moving one of the upper die and the lower die with respect to each other to increase the distance between the upper die and the lower die to release stored forces in the upper and lower dies and the press;

(d) readvancing the upper die with the continued advance of the upper platen through the material sheet; and (e) retracting the upper die and the upper platen to the open position.

Preferably, the method comprises sequentially creating a relative advance and retraction of the upper die, followed by a controlled acceleration of the die into the material being stamped in a plurality of discrete steps of progressing distance through the total thickness of the material being stamped.

By these embodiments, the force on the press is relieved by stopping and then reversing the relative motion of the upper and lower dies in such a way so as to control the release of stored forces in the dies and the press frame without the generation of objectionable shock, noise, and vibration. The reduced shock, noise, and vibration levels provided by the control apparatus and method of the present invention is achieved by a simple control apparatus and method which does not significantly increase the cycle time of a stamping press.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
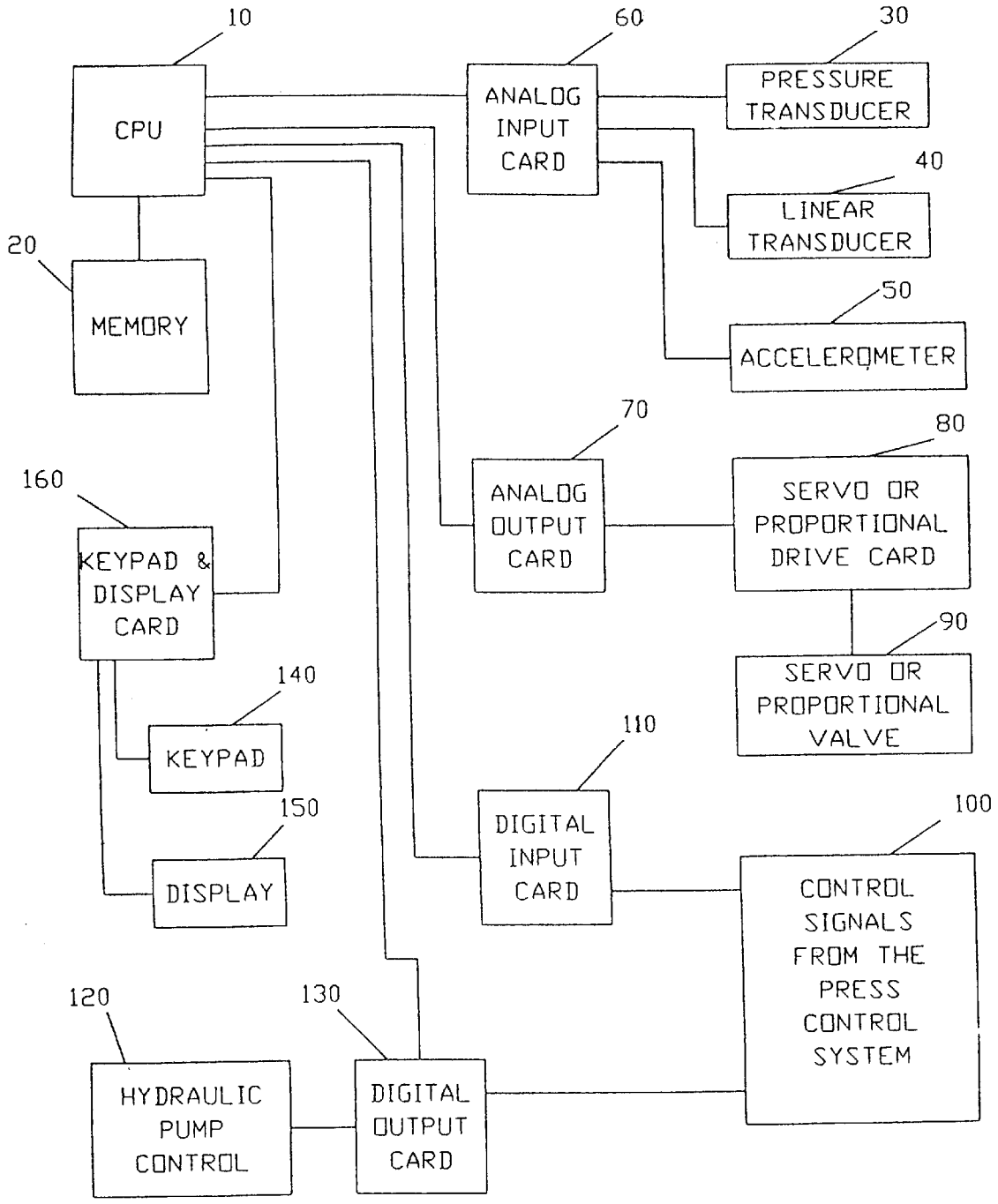
FIG. 1 is a block diagram of a control apparatus of the present invention employed to operate a cylinder and slide of a first embodiment.

Throughout the following description and drawing, an identical reference number is used to refer to the same component shown in multiple figures of the drawing.

The present invention is a control apparatus and method for reducing the shock, noise, and vibrations generated by energy stored in a mechanical press during a stamping or shearing operation.

Figure 2:
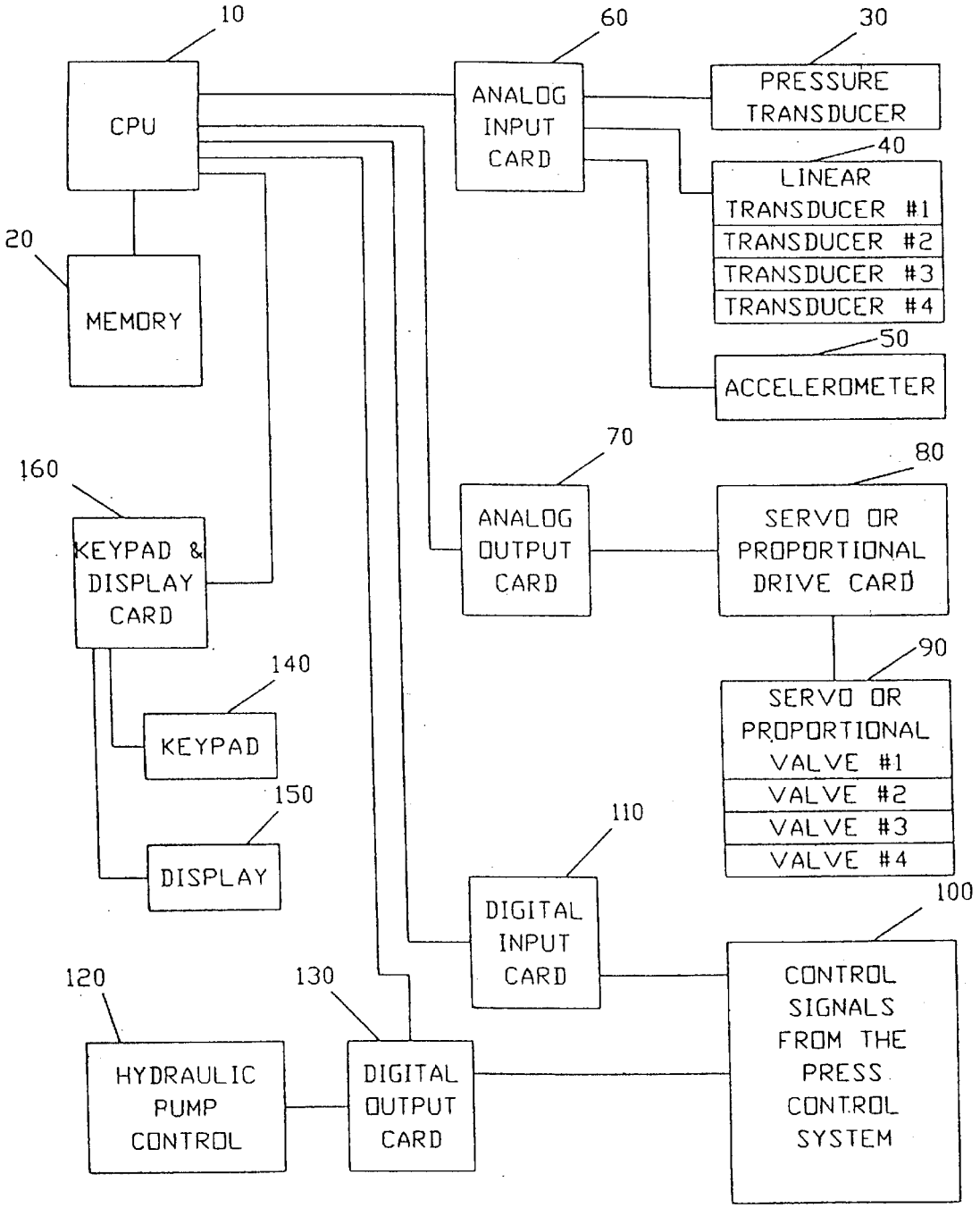
FIG. 2 is a block diagram of a control apparatus of the present invention employed to operate a plurality of cylinders of a second embodiment.

As can be seen from FIGS. 1 and 2, the same basic control apparatus is used for both embodiments of the present invention, the only difference being the number of individual distance measuring means, i.e., linear transducers, and the number of individual valve means, i.e., servo or proportional valves. The length and type of linear transducer will vary according to the size and requirements of the press being used. The selection of servo or proportional valves will likewise vary according to the size requirements of the press being used. The stored control program will be different for the first and second embodiments due to the difference in the number of linear transducers and valves. However, the main functioning of the overall program is the same.

In the first and second embodiments, shown in FIGS. 1 and 2, the control apparatus includes a central processing unit or CPU 10 which executes a control program stored in a memory 20. This stored program utilizes set points determined during a set-up mode which is also a part of the stored program. This set-up mode functions once when the operator of the press starts a new roll of material into the press and is initiated by the operator through pushbutton controls on the main operator console provided by the press manufacturer. The set-up mode will not function again until the control apparatus determines that no material is left in the press. The presence of material (or the lack of it) is determined by the force recorded from a pressure transducer 30.

The CPU 10 responds to the position of the upper die in relation to the lower die as determined by the output of a die travel distance measuring means, such as a linear transducer 40. The CPU 10 has the capability to make small adjustments to the set points determined during the set-up mode. An accelerometer 50, mounted on the press frame, is used to monitor the amount of shock and vibration generated during operation of the press. This information is input to and used by the CPU 10 to adjust the set points in order to obtain the minimum amount of shock and vibration during operation of the press. The input signals from the pressure transducer 30, the linear transducer 40, and the accelerometer 50 are generally analog signals and are converted into digital values or numbers for use by the CPU 10 by an analog input card 60. The analog input card 60 is an 8 input, 16 bit analog to digital converter circuit board, by way of example.

The CPU 10 also sends signals to valve means 90 formed of a servo or proportional valve or valves through an analog output card 70. The analog output card 70 is an 8 output, 12 bit digital to analog converter circuit board, by example. Analog output signals from the analog output card 70 control one or more servo or proportional valve drive circuits or cards 80. The valve drive cards 80 are generally produced by the valve manufacturers, and are used by the CPU 10 to generate control signals to the servo or proportional valve 90.

The CPU 10 also responds to control signals generated by a press control system 100, and selects various modes of operation based on such control signals. This allows the operator to select manual or automatic operation, set-up mode, and to start and stop the operation of the control apparatus of the present invention. These control signals are input to the CPU 10 through a digital input card 110. The digital input card is a 48 input, TTL compatible circuit board which is structured to interface to two OPTO-22 24 point cards. Such cards have plug-in modules capable of interfacing to various A.C. and D.C. devices, thus providing needed flexibility for interfacing to various control systems in the international market.

Figure 3:
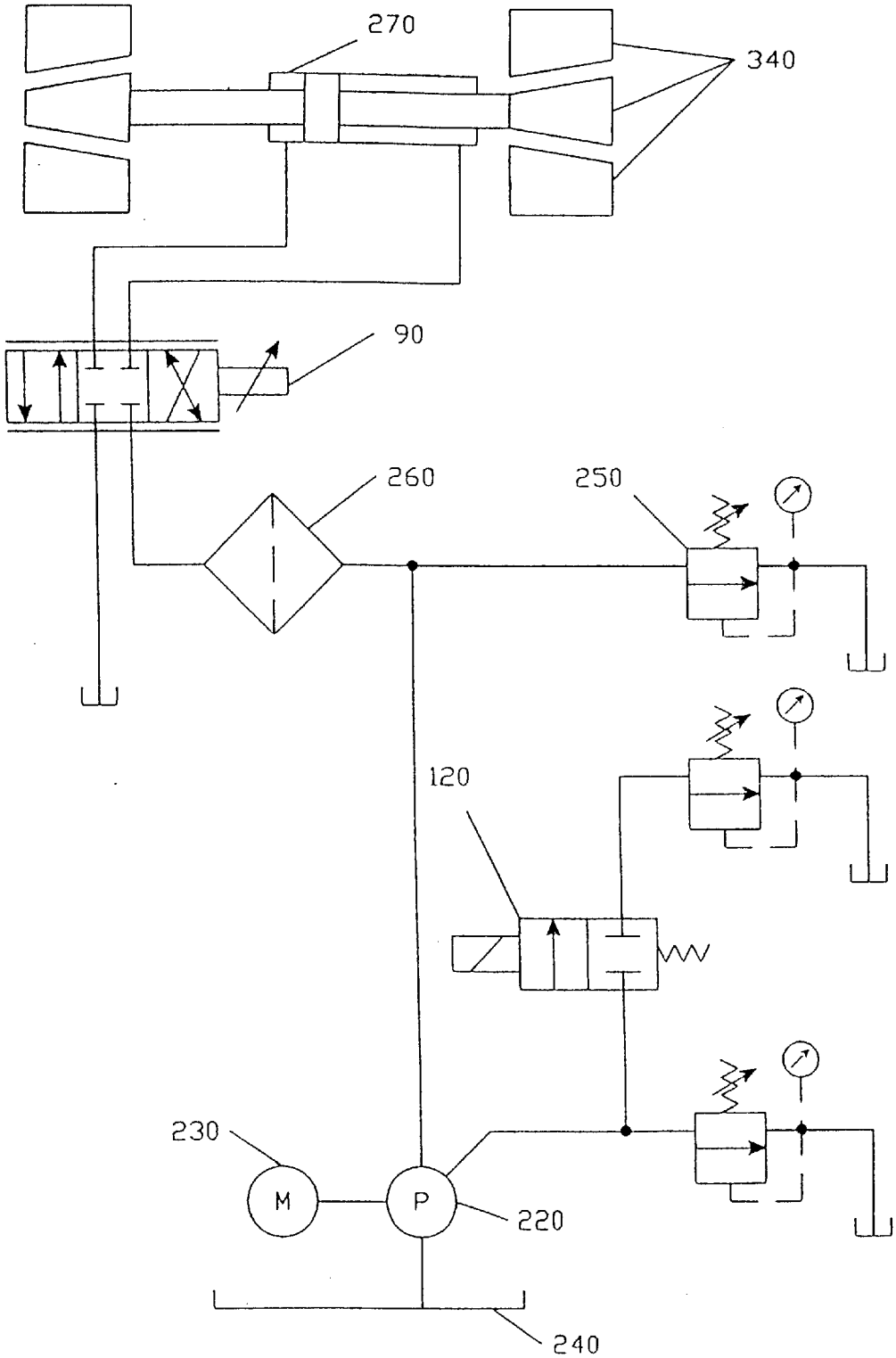
FIG. 3 is a schematic diagram of the fluid circuit of the control apparatus of the first embodiment of the present invention.
Figure 4:
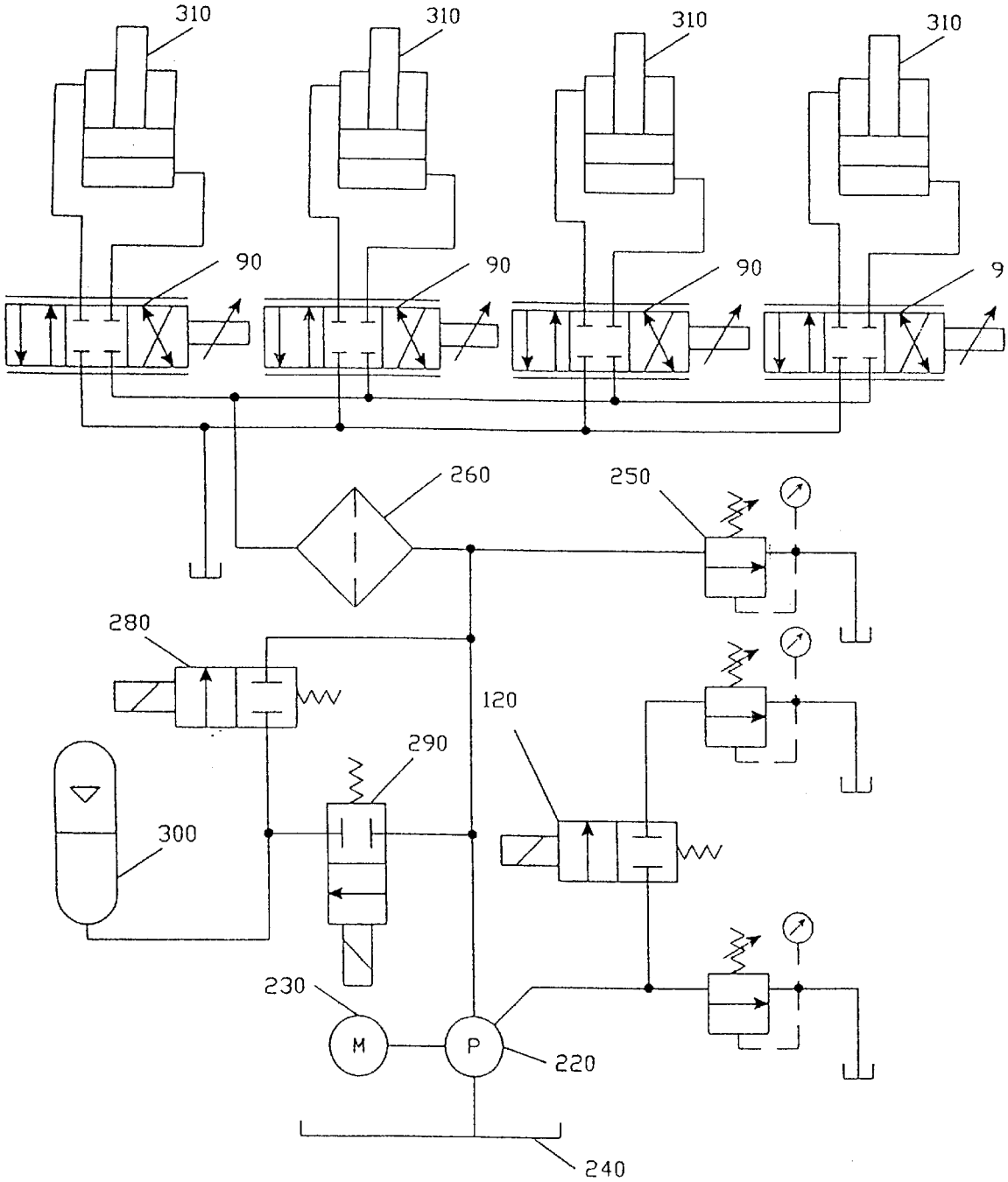
FIG. 4 is a schematic diagram of the fluid circuit of the control apparatus of the second embodiment of the present invention.

The CPU 10 also sends signals to a hydraulic power unit pressure control 120 also shown in FIGS. 3 and 4, as well as to the press control system 100. These control signals are output through a digital output card 130. The digital output card is a 40 output, TTL compatible circuit board. This TTL output board is structured to interface to one OPTO-22 24 point card, and one OPTO-22 16 point card. Such an output card 130 also has plug in modules capable of interfacing to various A.C. and D.C. devices.

The CPU 10 also responds to inputs from a keypad 140 mounted on the control apparatus enclosure. This allows emergency access to the control apparatus operation and also allows access to diagnostic information generated by the control apparatus which is displayed, when requested, on an LCD display 150, also mounted on the control apparatus enclosure. The keypad 140 and the LCD display 150 are controlled by a keypad and display circuit card 160. The circuit card 160 is a custom-printed circuit board designed and constructed to interface to the keypad 140 and the LCD display 150.

The hydraulic system of a mechanical press operates at two different pressures. The lowest pressure is used during system start-up to keep the initial load on the hydraulic power unit to a minimum. This initial pressure is approximately 500 psig, for example, and is the default pressure setting for the hydraulic system. The intermediate pressure is set by pressure control 120 and is activated by the CPU 10 through the digital output card 130. The high system pressure is set to approximately 1200 psig, for example. The pressure controls are mounted in a stacked arrangement on a hydraulic pump 220. The hydraulic pump 220 is driven by an electric motor 230, which provides the rotational force to drive the hydraulic pump 220. The hydraulic fluid is drawn from a fluid reservoir 240 where it is returned after being used by the cylinder, or cylinders, in the press hydraulic system. A pressure relief 250 is provided to limit maximum system pressure, and is set at 1500 psig, for example. Because of the sensitivity of servo valves to particle contamination, a three micron filter 260 is provided to protect the servo, or proportional valve 90 from damage.

Figure 5A:
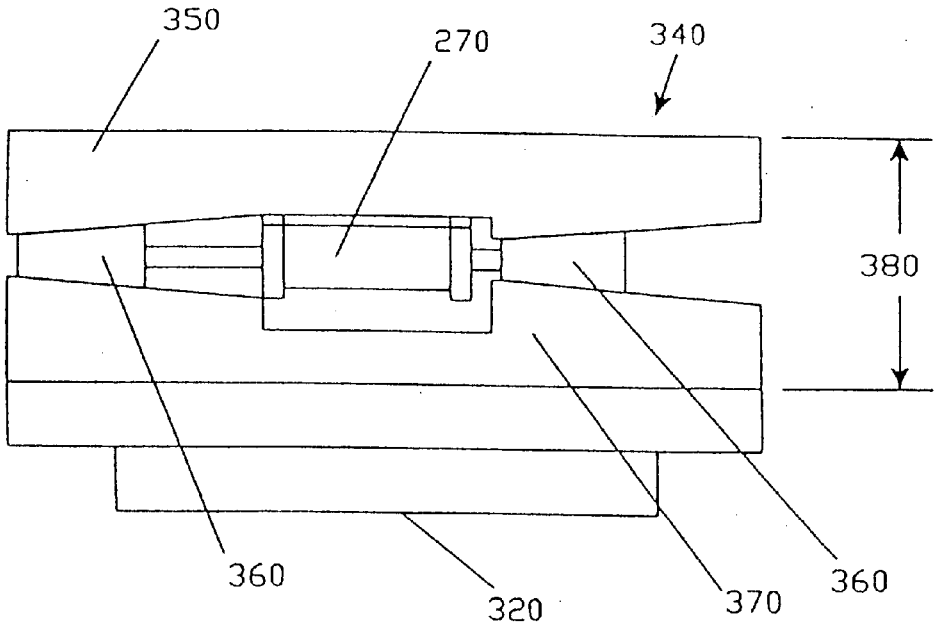
FIG. 5A is a partial, side elevational view of a three layered wedge plate assembly of the first embodiment shown in the open position.
Figure 5B:
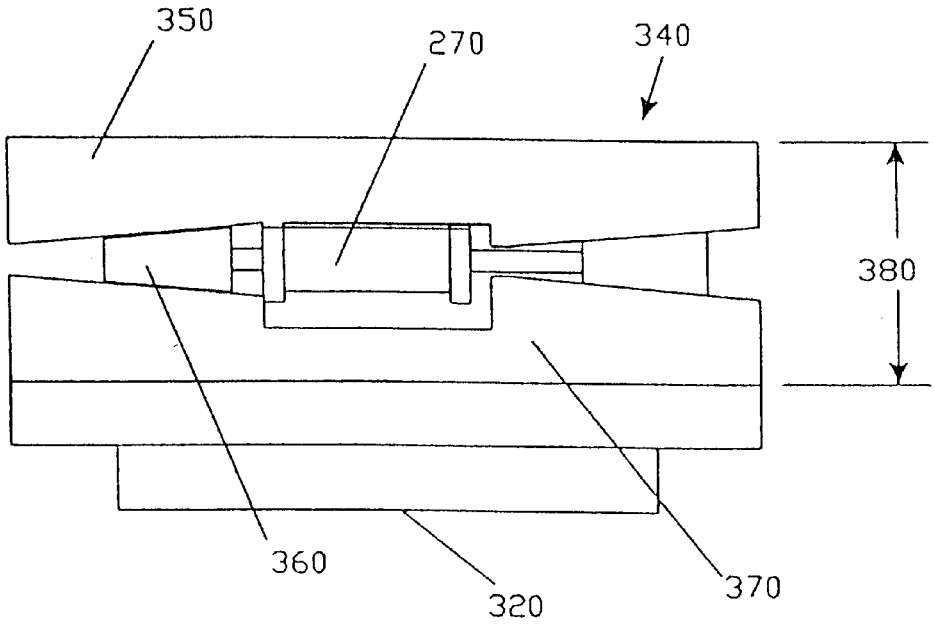
FIG. 5B is a partial, side elevational view of the three layered wedge plate assembly of the first embodiment shown in the closed position.

In the first embodiment shown in FIGS. 1 and 3, an adjustable plate apparatus includes a hydraulic cylinder 270 which is extended and retracted by a servo or proportional valve 90 in response to signals generated by the CPU 10 and output through the analog output card 70 and the servo or proportional drive card 80. As shown in FIGS. 3, 5A and 5B, hydraulic cylinder 270 moves separating means or captive wedges 360 between a fixed upper plate 350 and a movable lower plate 370 which may be biasingly coupled to the upper plate 350. The wedges 360, the fixed upper plate 350 and the movable lower plate 370 form a means for creating a momentary changed separation distance or dimension 380 between the upper plate 350 and the lower plate 370. During operation, the three-layered plate assembly 340, starts out in the open position as depicted in FIG. 5A. As the press moves an upper platen 325 to force the upper die 330 into material 320 being stamped, valve 90 is activated to cause cylinder 270 to move the captive wedges 360. This movement results in a rapid change in dimension 380 that is opposite to the direction of the downward motion of the upper platen 325 and upper die 330. The end effect of this movement is to create a stoppage and a small reversal in relative motion between the upper die 330 and the material 320 being stamped which is disposed in a lower die 332 mounted on a lower platen 334. This movement releases the stored forces in the dies and the press frame under control of the control apparatus. The motion is brought to a controlled stop by closing the fluid flow through valve 90, thus stopping the motion of the piston rods in cylinder 270.

As the downward motion of the upper platen 325 continues, the upper die 330 is forced again into the material being stamped. At a second point, or at multiple subsequent points, determined during set-up mode, the valve 90 is again activated to move cylinder 270 and the captive wedges 360 as described above. The wedges 360 are positioned at the end of its final movement as shown in FIG. 5B, where the three-layered plate assembly 340 is completely closed, presenting a firm, consistent dimension 380 for critical die functions like coining, etc.

Further details concerning the selection and use of multiple points or steps in the operation of the present invention can be had by referring to U.S. Pat. Nos. 5,176,054 and 5,042,336, issued in the name of the present inventor, the contents of each of which are incorporated herein by reference.

Figure 9C:
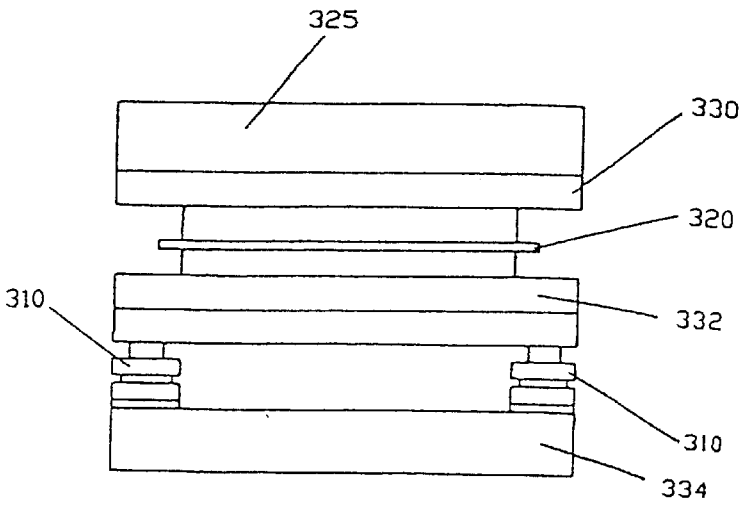
FIGS. 9A–9C are side elevational views showing alternate dampening cylinder mounting positions.
Figure 9A:
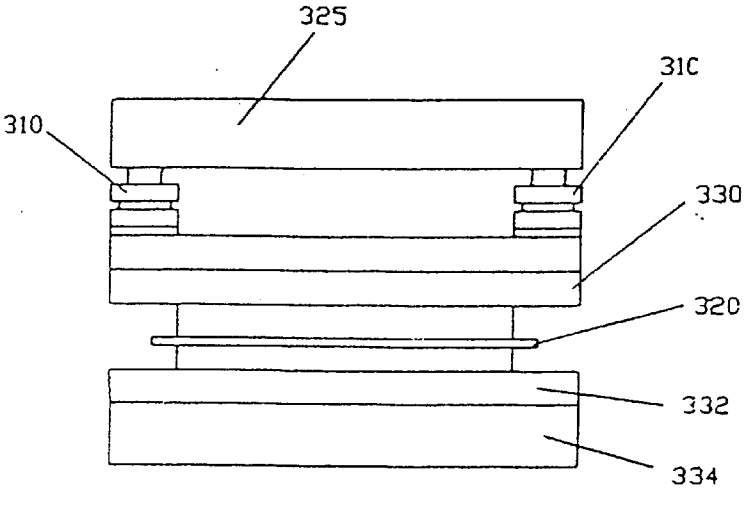
Figure 9B:
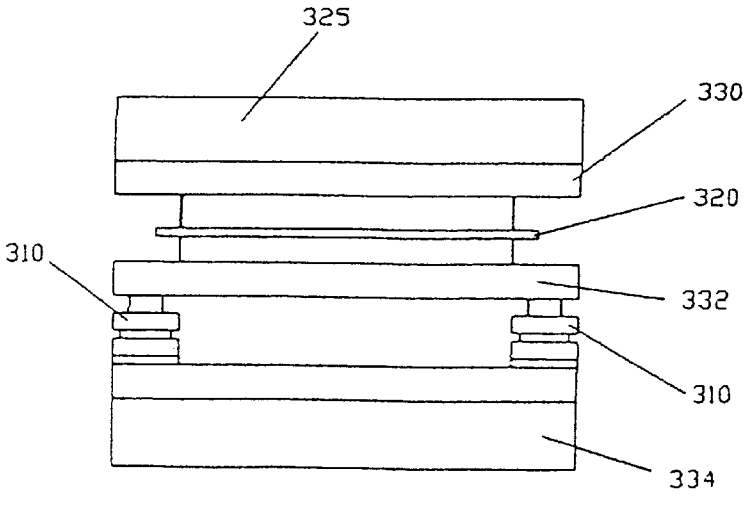

In the second embodiment, shown in FIGS. 2 and 4, one or more, but preferably four hydraulic cylinders 310 are mounted between the press upper platen 325 and the upper die 330, see FIG. 9A, or mounted between the lower platen 325 and the press frame 335 as shown in FIG. 9C, or mounted to the lower platen 334 between the lower die 332 as shown in FIG. 9B. These cylinders 310 move the upper die or the lower die so as to create the same relative motion between the upper die 330 and the material 320 being stamped as described above. Because of the higher fluid volume required, an accumulator 300 is added to the fluid system. During use, the accumulator 300 is charged by fluid flow through cartridge valve 290 as shown in FIG. 4. Charging of the accumulator 300 takes place during the time that the upper platen is being returned to the top of the cycle. Once the accumulator 300 is charged with fluid, cartridge valve 290 is closed. When the additional fluid flow is required to operate the cylinders 310, cartridge valve 280 is activated thus routing the pressurized fluid flow through the servo or proportional valves 90, and on to cylinders 310.

Figure 6:
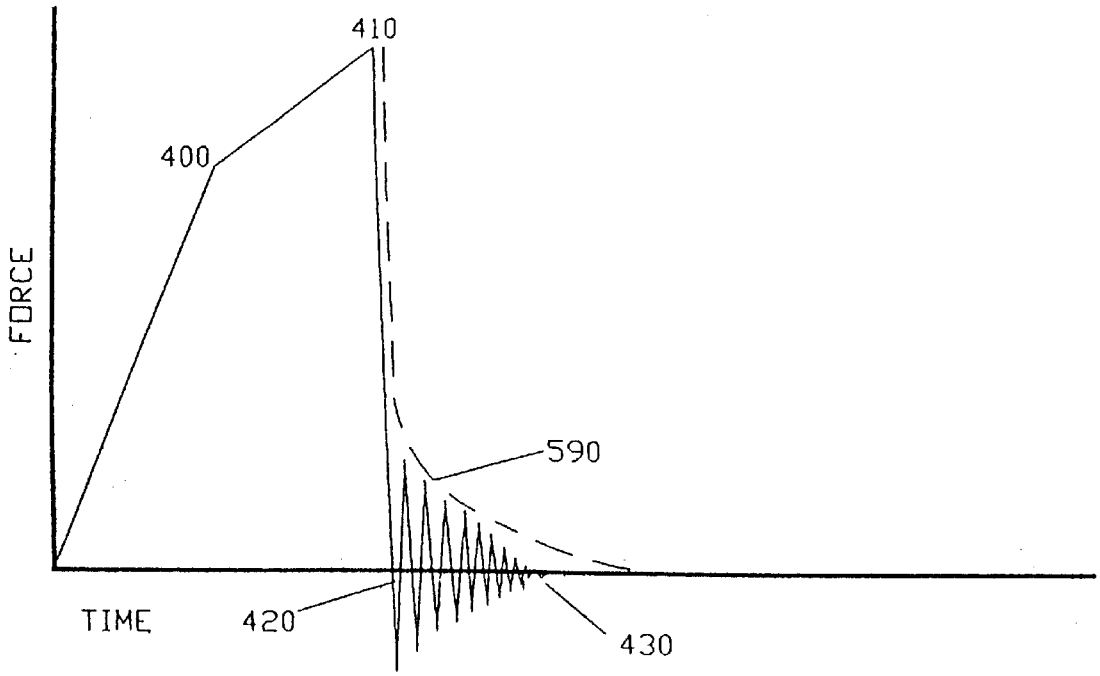
FIG. 6 is a graph depicting the uncontrolled release of stored forces in a conventional stamping press.

To understand how and why the present invention reduces shock, noise, and vibration in a press, a detailed examination of the generation of the shock is required. FIG. 6 is a graph depicting the application and uncontrolled release of force during normal operation of a stamping press. For a clearer understanding, the graph shows the force as a function of time for a die having one large punch with no shear. This simplifies the force-time graph and demonstrates clearly what takes place in the press.

As the upper die 330, shown in FIGS. 5A and 5B, is forced into the material 320 being stamped, the material 320 resists the motion of the upper die 330 and the applied force increases to point 400. At point 400, the point of elasticity of the material 320 is reached, and the material begins moving in response to the pressure applied by the upper die 330. As can be seen from FIG. 6, this creates a small change in the rate of increase of the force applied by the press. The force needed to deform and eventually break the material 320 is transmitted into the dies and the frame of the press in the form of compression, distortion, and deflection. When the yield point 410 of the material 320 is reached, the material breaks. With no material strength left to oppose the force of the press, the stored force in the form of compression, distortion, and deflection is released from the dies and the frame of the press. This rapid, uncontrolled release of force results in the rapid drop from point 410 to point 420, which represents zero force. Because this release of force is accompanied by physical motion in the dies and press frame, inertia carries the motion beyond the zero point 420. A "ringing" occurs in the dies and the press frame, which decays over time to point 430, which represents a stable zero force condition, as compared to the unstable zero force condition of point 420. The "ringing" is the generation of shock, noise, and vibration by the stamping press and is generated in exactly the same way for each and every cycle of the press.

Figure 8:
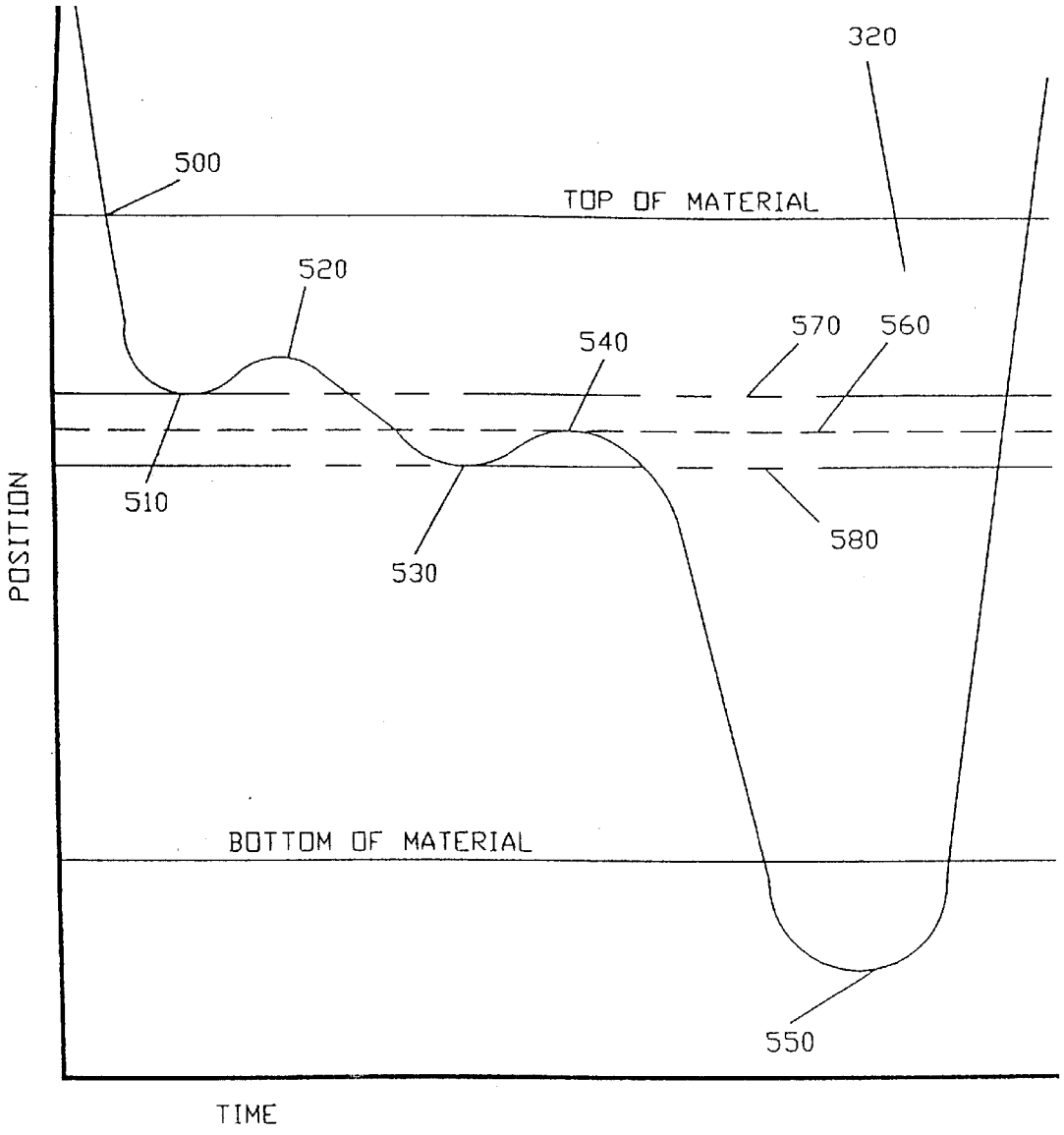
FIG. 8 is a graph depicting relative upper die position as a function of time during one cycle of the press.

In FIG. 8, the process of this invention can be fully appreciated. During set-up mode, as described above, point 500, which is the position of the top of the material 320, is determined. This is done by recording the dimension from the linear transducer 40, shown in FIGS. 5A and 5B, at which the pressure rises rapidly as detected by the pressure transducer 30. Point 560 is also determined during set-up mode. Point 560 is the point at which material 320 breaks and is determined by recording the dimension from linear transducer 40 when the pressure as measured by pressure transducer 30 drops. Point 570 is a calculated point above point 560 where the material 320 has almost reached the limit of its elasticity, but has not broken. It is at this point that fracture of the material 320 has begun but structural failure of the material has not occurred. Point 580 is also a calculated point where the material 320 has become completely fractured and the structural failure of the material has occurred.

During operation of the present invention, a reverse motion is created by the action of the first or second embodiment as described above at point 500. This reverse motion increases to the point 510 where the downward motion of the upper platen 325 and upper die 330 is matched by the reverse motion generated by the control apparatus. The reverse motion is increased so that the downward motion of the upper platen 325 is overcome by the motion created by the control apparatus. The CPU 10 executes the acceleration and deceleration of the valve or valves 90 so that point 510 coincides with the first predetermined point 570. The controlled motion from point 510 to point 520 releases the stored forces in the dies and the press frame at a rate that will not generate the objectionable shock and noise generally produced by the press. The valve, or valves 90, then close off the fluid flow thus returning the downward motion of the upper die 330 to that of the upper platen 325. This same process is repeated, so that the stop in downward motion at point 530 coincides with the second point 580. The forces are again released by reverse motion to point 540, at which time the valve or valves 90 are closed and the normal downward motion of the upper platen 325 is resumed. The upper die 330 closes to its designed closed position at point 550 and then returns to the normal open position of the press. During the opening of the press, CPU 10 operates valve or valves 90 so that the piston rod(s) of cylinder 270 or cylinders 310 are returned to their starting position.

Figure 7:
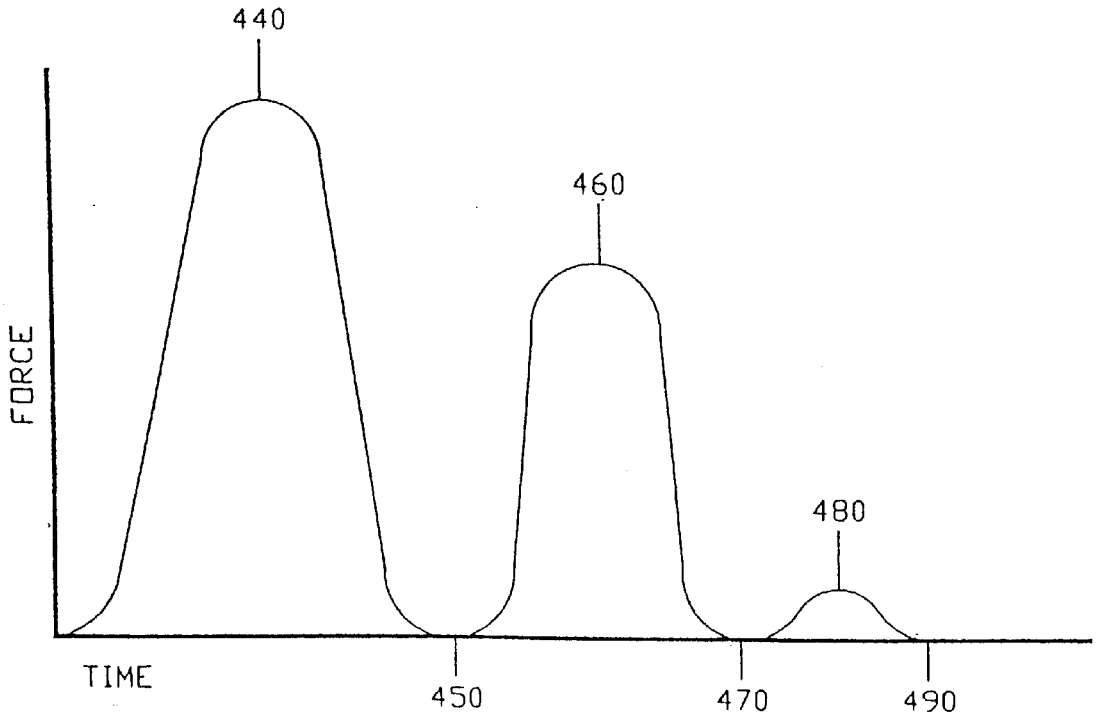
FIG. 7 is a graph depicting the controlled release of forces by the present invention.

With the apparatus and process of the present invention in operation, the force-time graph of FIG. 6 now looks like the force-time graph of FIG. 7. As can be seen by comparing FIG. 7 and FIG. 8, the motion that produces point 510 also produces the pressure at point 440. Likewise, the motion that produces point 520 also produces the pressure at point 450. As we continue, point 530 correlates to point 460, and point 540 correlates to point 470. At this point the material 320 has been fractured and the section being stamped out is only being held in place by friction. The residual forces in the dies and press frame have been released under controlled conditions. The only thing left to do is push the fractured section out of material 320. This is done by the motion from point 540 to point 550. This results in a small rise and release of force as depicted by point 480. When the stroke of the press reaches point 550, the force has returned to zero at point 490.

The acceleration and deceleration rates for valve or valves 90 are created so as to match or closely resemble the decay curve in FIG. 6 represented by line 590. This allows the maximum movement and also results in the minimum press cycle time without the generation of objectionable shock, noise, and vibration.

What is claimed is:

1. A method of shearing a workpiece from a material sheet disposed in a press having a movable upper platen, an upper die, a lower die and a lower platen, the method comprising the steps of:

advancing the upper platen and the upper die from an open position spaced from the lower die toward the lower die;

measuring a distance travelled by the upper die in relation to the lower die;

at a first predetermined distance of advance of the upper die through the material sheet and while the upper platen continues to advance toward the lower die, momentarily moving one of the upper die and the lower die with respect to the other of the upper die and the lower die to increase a distance of separation between the upper die and the lower die to release stored forces in the upper and lower dies and the press, fixedly mounting an upper plate to the upper platen;

fixedly mounting a lower plate to the upper die;

movably disposing a separating means between the upper and lower plate; and controlling the separating means to control the separation of the upper and lower plates with respect to each other to generate a relative movement of the upper die with respect to the upper platen;

readvancing the upper die with a continued advance of the upper platen through the material sheet; and retracting the upper die and the upper platen to the open position.

2. The method of claim 1 further comprising the steps of:

determining a distance of advance of the upper die through the material sheet at which the material sheet starts to fracture; and setting the first predetermined distance to the distance of advance of the upper die at which fracture starts.

3. The method of claim 1 further comprising the steps of:

advancing the upper die and the upper platen from the first predetermined distance to a second predetermined distance through the material sheet, the second predetermined distance being less than a total thickness of the material sheet;

at the one second predetermined distance and while the upper platen continues to advance toward the lower die, momentarily increasing a distance separating the upper and lower dies to release stored forces in the upper and lower dies and the press.

4. The method of claim 1 further comprising the steps of:

forming the separating means of a fluid-operated cylinder having first and second piston rods extensibly and retractibly extending outward from opposite ends of the cylinder;

mounting a wedge member with opposed wedge faces on each of the first and second piston rods;

forming wedge surfaces on the upper and lower plates;

engaging the wedge surfaces with the wedge faces of the wedge members to separate and close the upper and lower plates with respect to each other as the first and second piston rods alternately extend and retract from the cylinder; and controlling a flow of pressurized fluid to the cylinder to effect movement of the first and second piston rods to separate and close a distance between the upper and lower plates.

5. A method of shearing a workpiece from a material sheet disposed in a press having a movable upper platen, an upper die, a lower die and a lower platen, the method comprising the steps of:

advancing the upper platen and the upper die from an open position spaced from the lower die toward the lower die;

measuring a distance travelled by the upper die in relation to the lower die;

at a first predetermined distance of advance of the upper die through the material sheet and while the upper platen continues to advance toward the lower die, momentarily moving one of the upper die and the lower die with respect to the other of the upper die and the lower die to increase a distance of separation between the upper die and the lower die to release stored forces in the upper and lower dies and the press;

mounting at least one fluid-operated cylinder having an extensible piston rod between the upper die and the upper platen;

controlling a flow of pressurized fluid to the cylinder to retract the piston rod when the upper die reaches the first predetermined distance of advance through the material sheet to cause a reverse movement of the upper die with respect to the upper platen;

readvancing the upper die with a continued advance of the upper platen through the material sheet; and retracting the upper die and the upper platen to the open position.

6. A method of shearing a workpiece from a material sheet disposed in a press having a movable upper platen, an upper die, a lower die and a lower platen, the method comprising the steps of:

advancing the upper platen and the upper die from an open position spaced from the lower die toward the lower die;

measuring a distance travelled by the upper die in relation to the lower die;

at a first predetermined distance of advance of the upper die through the material sheet and while the upper platen continues to advance toward the lower die, momentarily moving one of the upper die and the lower die with respect to the other of the upper die and the lower die to increase a distance of separation between the upper die and the lower die to release stored forces in the upper and lower dies and the press;

mounting at least one fluid-operated cylinder having an extensible piston rod between the lower die and the lower platen;

controlling a flow of pressurized fluid to the cylinder to retract the piston rod when the upper die reaches the first predetermined distance of advance through the material sheet to cause a reverse movement of the lower die with respect to the lower platen;

readvancing the upper die with a continued advance of the upper platen through the material sheet; and retracting the upper die and the upper platen to the open position.

7. A method of shearing a workpiece from a material sheet disposed in a press having a movable upper platen, an upper die, a lower die, a lower platen, the press including a press frame supporting the upper platen and the lower platen, the method comprising the steps of:

advancing the upper platen and the upper die from an open position spaced from the lower die toward the lower die;

measuring a distance travelled by the upper die in relation to the lower die;

at a first predetermined distance of advance of the upper die through the material sheet and while the upper platen continues to advance toward the lower die, momentarily moving one of the upper die and the lower die with respect to the other of the upper die and the lower die to increase a distance of separation between the upper die and the lower die to release stored forces in the upper and lower dies and the press;

mounting at least one fluid-operated cylinder having an extensible piston rod extending outward from the cylinder between the lower platen and one of the lower die and the press frame;

at the first predetermined distance of advance of the upper die through the material sheet and while the upper platen continues to advance toward the lower die, momentarily moving one of the upper die and the lower die with respect to each other to increase a distance between the upper die and the lower die at the first predetermined distance to release stored forces in the upper and lower dies and the press by initiating a relative movement between the lower platen and one of the lower die and press frame;

readvancing the upper die with a continued advance of the upper platen through the material sheet; and retracting the upper die and the upper platen to the open position.

8. The method of claim 7 further comprising the step of:

mounting at least one fluid-operated cylinder between the lower die and the lower platen.

9. The method of claim 7 further comprising the step of:

mounting at least one fluid-operated cylinder between the lower platen and the press frame.

10. An apparatus for shearing a workpiece from a material sheet disposed in a press having a movable upper platen, an upper die, a lower die and a lower platen, the apparatus comprising:

means for measuring the travel distance of the upper die from a normal open position spaced from the lower die, a distance measuring means generating an output signal indicative of such travel distance;

means for creating a momentary changed separation distance between the upper and lower dies during advance of the upper platen and the upper die toward the lower platen and the lower die, the momentary changed separation distance means including:

an upper plate fixed to the upper platen; and a lower plate fixed to the upper die; and control means, executing a stored control program in response to the output signal from the distance measuring means, for controlling the momentary change separation distance means to momentarily changed a separation distance between the upper and lower dies at a first predetermined distance of advance of the upper die through the material sheet, the first predetermined distance being less than a total thickness of the material sheet.

11. The apparatus of claim 10 further comprising:

the control means establishes the first predetermined distance as the distance of advance of the upper die through the material sheet at which the material sheet begins to fracture.

12. The apparatus of claim 10 wherein the momentary changed separation distance means further comprises:

a fluid-operated cylinder with opposite ends, the fluid-operated cylinder having first and second piston rods extensibly and retractibly extending outward from the opposite ends of the cylinder;

a wedge member mounted on each of the first and second piston rods, the wedge member having opposed wedge faces; and wedge surfaces formed on the upper and lower plates and complimentarily engage with the wedge faces of each wedge member upon movement of the first and second piston rods to separate and close the upper and lower plates with respect to each other as the piston rods alternatingly extend and retract from the cylinder;

valve means for controlling flow of pressurized fluid to the cylinder;

the control means, in response to the output signal of the distance measuring means, controlling the valve means to supply pressurized fluid to the cylinder to cause the first and second piston rods to move in a direction to decrease the separation distance between the upper and lower plates at the first predetermined distance.

13. An apparatus for shearing a workpiece from a material sheet disposed in a press having a movable upper platen, an upper die, a lower die and a lower platen, the apparatus comprising:

means for measuring a travel distance of the upper die from a normal open position spaced from the lower die, the distance measuring means generating an output signal indicative of such travel distance;

means for creating a momentary increased separation distance between the upper and lower dies during advance of the upper platen and the upper die toward the lower platen and the lower die, the momentary changes separation distance means including:

at least one fluid-operated cylinder having an extensible piston rod extending therefrom disposed between the upper platen and the upper die;

control means controlling a flow of pressurized fluid to the fluid-operated cylinder in response to the output signal from the distance measuring means to momentarily close the upper die with respect to the upper platen to increase the separation distance between the upper and lower dies when the upper die advances to the first predetermined distance through the material sheet; and control means, executing a stored control program in response to the output signal from the distance measuring means, for controlling the momentary changed separation distance means to momentarily change a separation distance between the upper and lower dies at a first predetermined distance of advance of the upper die through the material sheet, the first predetermined distance being less than a total thickness of the material sheet.

14. The apparatus of claim 13 further comprising:

means for accelerating and decelerating the piston rod of the at least one fluid-operated cylinder during extension and retraction of the piston rod.

15. The apparatus of claim 14 wherein the accelerating and decelerating means comprises:

valve means for controlling the direction of pressurized fluid flow to the at least one fluid-operated cylinder to extend and retract the piston rod.

16. The apparatus of claim 13 wherein the momentary changed separation distance means comprises:

at least one fluid-operated cylinder having an extensible piston rod extending outward therefrom and mounted between the lower platen and the lower die.

17. The apparatus of claim 13 wherein the momentary changed separation distance means further comprises:

at least one fluid-operated cylinder having an extensible piston rod extending therefrom mounted between the lower platen and the press frame.

* * * * *